US010563444B2

(12) United States Patent
Yao et al.

(10) Patent No.: US 10,563,444 B2
(45) Date of Patent: Feb. 18, 2020

(54) DOOR OPENING AND CLOSING DEVICE AND REFRIGERATOR

(71) Applicants: HEFEI HUALING CO., LTD., Hefei (CN); MIDEA GROUP CO., LTD., Foshan (CN)

(72) Inventors: Jun Yao, Hefei (CN); Mingbo Jiang, Hefei (CN)

(73) Assignees: HEFEI HUALING CO., LTD., Hefei (CN); MIDEA GROUP CO. LTD., Foshan (CN)

( * ) Notice: Subject to any disclaimer, the term of this patent is extended or adjusted under 35 U.S.C. 154(b) by 0 days.

(21) Appl. No.: 16/198,371

(22) Filed: Nov. 21, 2018

(65) Prior Publication Data

US 2019/0093410 A1 Mar. 28, 2019

Related U.S. Application Data

(63) Continuation of application No. PCT/CN2016/090229, filed on Jul. 15, 2016.

(30) Foreign Application Priority Data

May 27, 2016 (CN) ..... 2016 1 0384164

(51) Int. Cl.
*E05F 15/02* (2006.01)
*E05F 15/614* (2015.01)
*F25D 23/02* (2006.01)

(52) U.S. Cl.
CPC ..... *E05F 15/614* (2015.01); *F25D 23/02* (2013.01); *F25D 23/028* (2013.01);
(Continued)

(58) Field of Classification Search
CPC . E05F 15/614; E05F 15/619; E05F 2201/246; E05F 2201/214;
(Continued)

(56) References Cited

U.S. PATENT DOCUMENTS 5,040,857 A * 8/1991 Mandel ..... E05D 3/022 16/364
7,213,369 B2 * 5/2007 Freeman ..... G10L 15/26 49/358
(Continued)

FOREIGN PATENT DOCUMENTS

CN 2422600 3/2001
CN 2426508 4/2001
(Continued)

OTHER PUBLICATIONS

International Search Report, PCT/CN2016/090229, dated Dec. 30, 2016, 15 pgs.
(Continued)

*Primary Examiner* — Jerry E Redman
(74) *Attorney, Agent, or Firm* — Morgan, Lewis & Bockius LLP

(57) ABSTRACT

The present disclosure provides a door opening and closing device, and a refrigerator. A door of the refrigerator is rotatably connected to a refrigerator body by means of a rotating shaft, wherein the rotating shaft is fixedly connected to the door, the door opening and closing device includes a connecting rod, a first drive means, a second drive means and an elastic member. The connecting rod is arranged on the door, and the connecting rod includes a first end and a second end that matches a shaft hole. The first drive means is connected to the connecting rod and is configured to drive the connecting rod to rotate. The second drive means is configured to drive the connecting rod to move towards the shaft hole, and cause the second end of the connecting rod to be inserted into the shaft hole.

19 Claims, 9 Drawing Sheets

(52) U.S. Cl.
CPC ... *E05Y 2201/214* (2013.01); *E05Y 2201/246* (2013.01); *E05Y 2201/462* (2013.01); *E05Y 2600/13* (2013.01); *E05Y 2900/31* (2013.01)

(58) Field of Classification Search
CPC .... E05F 2201/462; E05F 1/10; F25D 23/028; F25D 23/02; E05Y 2600/13; E05Y 2900/31
USPC ..... 49/333, 334, 335
See application file for complete search history.

(56) References Cited

U.S. PATENT DOCUMENTS

| | | | | |
|---|---|---|---|---|
| 7,887,147 | B2 * | 2/2011 | Karg | E05F 1/1066 312/319.2 |
| 9,581,381 | B2 * | 2/2017 | Jung | E05F 15/611 |
| 10,260,797 | B2 * | 4/2019 | Kim | H02P 29/10 |
| 10,309,143 | B2 * | 6/2019 | Eom | F25D 23/028 |
| 10,407,961 | B2 * | 9/2019 | Fox | E06B 3/4672 |
| 2005/0262868 | A1 * | 12/2005 | Jeong | E05F 1/1091 62/408 |
| 2009/0033189 | A1 * | 2/2009 | Glanz | E05F 1/105 312/405 |
| 2010/0141107 | A1 * | 6/2010 | Kim | F25D 23/028 312/405 |
| 2011/0048060 | A1 * | 3/2011 | Kim | E05B 17/0029 62/449 |
| 2011/0083461 | A1 * | 4/2011 | Kim | F25D 23/028 62/264 |
| 2014/0268648 | A1 * | 9/2014 | Gomes | F25D 27/005 362/94 |
| 2014/0327353 | A1 * | 11/2014 | Seo | F25D 23/028 312/405 |
| 2015/0241113 | A1 * | 8/2015 | Kim | E05D 7/00 312/405 |
| 2016/0312516 | A1 * | 10/2016 | Heydel | H02K 7/116 |
| 2016/0313050 | A1 * | 10/2016 | Yoon | F25D 11/02 |
| 2017/0097185 | A1 * | 4/2017 | Yasaka | E05F 15/614 |
| 2017/0261252 | A1 * | 9/2017 | Son | F25D 23/028 |
| 2017/0284144 | A1 * | 10/2017 | Yasaka | E05F 15/614 |
| 2017/0336132 | A1 * | 11/2017 | Chang | F25D 23/028 |
| 2018/0223582 | A1 * | 8/2018 | Shin | F25D 23/028 |
| 2018/0283077 | A1 * | 10/2018 | Lee | E05F 15/70 |
| 2018/0291669 | A1 * | 10/2018 | Kim | F25D 23/028 |
| 2019/0093409 | A1 * | 3/2019 | Yazawa | E05F 15/614 |

FOREIGN PATENT DOCUMENTS

| | | |
|---|---|---|
| CN | 2443126 | 8/2001 |
| CN | 204081836 | 1/2015 |
| CN | 104328971 | 2/2015 |
| CN | 205047032 U | 2/2016 |
| JP | 2016011786 A | 1/2016 |
| KR | 20120139316 | 12/2012 |

OTHER PUBLICATIONS

Office Action, CN201610384164.8, dated Jul. 18, 2017, 4 pgs.—No Translation Available.

* cited by examiner

DOOR OPENING AND CLOSING DEVICE AND REFRIGERATOR

RELATED APPLICATIONS

This application is a continuation application of PCT Patent Application No. PCT/CN2016/090229, entitled "DOOR OPENING AND CLOSING DEVICE AND REFRIGERATOR" filed on Jul. 15, 2016, which claims priority to Chinese Patent Application No. 201610384164.8, entitled "DOOR OPENING AND CLOSING DEVICE AND REFRIGERATOR" filed with the Chinese Patent Office on May 27, 2016, all of which are incorporated herein by reference in their entirety.

TECHNICAL FIELD

The present disclosure relates to the field of refrigeration equipment, and more particularly to a door opening and closing device, and a refrigerator including the door opening and closing device.

BACKGROUND

With respect to the existing refrigerators, especially large refrigerators of 500 liters or more, doors and refrigerator bodies are generally sealed by using soft door sealing strips with magnetic strips, wherein the door sealing strips are installed on the doors and are integral with the doors, the doors are magnetically attracted to the refrigerator bodies by the door sealing strips to realize the sealing between the doors and the refrigerator bodies, thereby achieving the function of heat preservation of the refrigerators.

As the contact surface between the door sealing strip and the refrigerator body is relatively long, and the interior of the refrigerator becomes a closed space due to the sealing between the refrigerator body and the door, when the door needs to be opened, due to the magnetic force and the negative pressure of the internal space, the door can be opened only by a relatively large force and the door can be opened by a force of 40-70N in general, such that it is very inconvenient for the elderly and the children to open the door.

SUMMARY OF THE DISCLOSURE

The present disclosure aims to at least solve one of the technical problems existing in the prior art.

Accordingly, the object of one aspect of the present disclosure is to provide a door opening and closing device.

The object of another aspect of the present disclosure is to provide a refrigerator including the above-mentioned door opening and closing device.

In order to achieve the above objects, according to an embodiment of the aspect of the present disclosure, a door opening and closing device for a refrigerator is provided, a door of the refrigerator being rotatably connected to a refrigerator body by means of a rotating shaft, wherein the rotating shaft is fixedly connected to the door, a shaft hole is formed in the rotating shaft, the door opening and closing device comprises: a connecting rod arranged on the door, which includes a first end and a second end that matches the shaft hole; a first drive means connected to the connecting rod and is configured to drive the connecting rod to rotate; a second drive means is configured to drive the connecting rod to move towards the shaft hole, and cause the second end of the connecting rod to be inserted into the shaft hole; and an elastic member, wherein after the second end of the connecting rod is inserted into the shaft hole, the elastic member is compressed, so that the elastic member can drive the connecting rod to move away from the shaft hole; and after the second drive means drives the second end of the connecting rod to be inserted into the shaft hole, the first drive means drives, by means of the connecting rod, the rotating shaft to rotate, so as to make the door rotate relative to the refrigerator body.

According to the door opening and closing device provided by the above-mentioned embodiment of the present disclosure, the rotating shaft is fixedly connected to the door, and the door is rotatably connected to the refrigerator body by means of the rotating shaft. When the second drive means operates, the second drive means drives the connecting rod to move towards the shaft hole and causes the second end of the connecting rod to be inserted into the shaft hole so as to achieve the connection between the connecting rod and the rotating shaft. At this time, the first drive means operates, the first drive means drives the connecting rod to rotate so as to drive, by means of the connecting rod, the rotating shaft to rotate, to open and close the door, Thus, automatic door opening and closing of the refrigerator is achieved, and the convenience for users, especially the elderly and the children, to use the refrigerator is improved. At this time, the elastic member is compressed, and after the second drive means stops operating, under the action of the restoring force of the elastic member, the connecting rod moves away from the shaft hole and is disengaged from the shaft hole. In this way, the rotating shaft is no longer connected to the first drive means, and the opening and closing of the door of the refrigerator can be realized manually. Therefore, when the refrigerator is powered off or the door opening and closing device is abnormal, the door can still be manually opened and closed.

It needs to be noted that, with respect to the sequence of energization (operating) of the second drive means and the first drive means, they can be powered on at the same time. At this time, under the action of the second drive means, the connecting rod moves close to the shaft hole. Meanwhile, under the drive of the first drive means, the connecting rod rotates, that is, the connecting rod rotates while moving close to the shaft hole and is inserted into the shaft hole. The second drive means and the first drive means cannot also be powered on simultaneously. For example, the second drive means is powered on firstly, and thus, under the action of the second drive means, the connecting rod moves close to the shaft hole and is inserted into the shaft hole, so that the rotating shaft and the connecting rod are connected as a whole. Then the first drive means is powered on to drive the connecting rod to rotate and drive the rotating shaft to rotate.

Preferably, a hinge bracket is fixedly connected to the door, a rotating shaft facing to the door is fixedly connected to the hinge bracket, a part of or all of the rotating shaft is located in the door. Further, an upper hinge bracket, on which a first rotating shaft is arranged, is fixedly connected to the upper end of the door, and a lower hinge bracket, on which a second rotating shaft is arranged, is fixedly connected to the lower end of the door. The first rotating shaft can be connected to or separated from the connecting rod of a first door opening and closing device, and/or, the second rotating shaft can be connected to or separated from the connecting rod of a second door opening and closing device.

In addition, the door opening and closing device according to the above-mentioned embodiment of the present disclosure further has the following additional technical features.

In the above technical solution, preferably, the second drive means is an electromagnet, a first through hole matching the first end of the connecting rod is formed in the electromagnet, the first end of the connecting rod penetrates the first through hole, and when the electromagnet is powered on, the electromagnet attracts the connecting rod to cause the connecting rod to move towards the shaft hole.

In the above embodiment, when the electromagnet is powered on, the electromagnet attracts the connecting rod to cause the connecting rod to move towards the shaft hole, and the second end of the connecting rod is inserted into the shaft hole, realizing the connection between the connecting rod and the rotating shaft. Therefore, the motor drives the rotating shaft to rotate through the connecting rod so as to open the door. Of course, the second drive means can also be a pinion and rack structure, and the movement of the connecting rod close to the shaft hole is realized by the transmission of the pinion and rack.

In the above technical solution, preferably, the elastic member is supported between the first end of the connecting rod and an end face of the electromagnet away from the shaft hole.

In the above embodiment, after the second end of the connecting rod is inserted into the shaft hole, the elastic member is compressed, and after the electromagnet is powered off, under the action of the restoring force of the elastic member, the connecting rod moves away from the shaft hole and is disengaged from the shaft hole. In this way, the rotating shaft is no longer connected to the first drive means, and the opening and closing of the door of the refrigerator can be realized manually. Therefore, when the refrigerator is powered off or the door opening and closing device is abnormal, the door can still be manually opened and closed.

The first drive means is a motor, and preferably a stepping motor.

The stepping motor can accurately control the rotation angle of the door, thereby improving the operating accuracy of the door opening and closing device. Preferably, the motor is a DC stepping motor.

In the above technical solution, preferably, the door opening and closing device further includes a reduction box connected between the motor and the connecting rod. A second through hole matching the second end of the connecting rod is formed in an output shaft of the reduction box, and the second end of the connecting rod penetrates the second through hole.

In the above embodiment, the reduction box is connected between the motor and the second end of the connecting rod, and the motor drives the connecting rod to rotate through the reduction box so as to drive the rotating shaft to rotate. The reduction box can convert the high rotating speed and the low torque of the motor into the low rotating speed and the high torque, thus better driving the rotating shaft to rotate.

In the above technical solution, preferably, the second end of the connecting rod has a polygonal cross section, and the shaft hole and the second through hole are both polygonal holes matching the second end of the connecting rod.

The setting of the polygonal cross section can better realize the transmission of torque between the reduction box and the rotating shaft. The polygon can be a triangle, a quadrangle, or the like.

Preferably, the first end of the connecting rod has a circular cross section, and correspondingly, the first through hole is a circular hole.

In the above technical solution, preferably, the axis of the shaft hole and the axis of the second through hole coincide with the axis of the connecting rod. Further, the axis of the shaft hole, the axis of the first through hole and the axis of the second through hole coincide with the axis of the connecting rod.

In the above embodiment, when the electromagnet is powered on, the connecting rod moves close to the shaft hole along the first through hole and penetrates the second through hole so as to be inserted into the shaft hole, causing the axis of the shaft hole to be coincided with the axis of the first through hole and the axis of the second through hole. Therefore, the smoothness of inserting the connecting rod into the shaft hole and the operating reliability of the door opening and closing device can be improved.

In the above technical solution, preferably, the elastic member is a spiral spring or a spring piece.

Preferably, an end face of the first end of the connecting rod away from the shaft hole extends outward to form an extension portion, and the elastic member is supported between the extension portion and an end face of one end of the electromagnet away from the shaft hole.

When the door opening and closing device is not powered on, under the action of the elastic force of the elastic member, the second end of the connecting rod is disengaged from the shaft hole. Preferably, the second end of the connecting rod still penetrates the second through hole, and at this time, the rotating shaft is not controlled by the door opening and closing device, and the door can be manually opened and closed. After the electromagnet is powered on, the electromagnet attracts the connecting rod, the connecting rod moves close to the shaft hole, and the second end of the connecting rod is inserted into the shaft hole. As such, the connecting rod, the output shaft of the reduction box and the rotating shaft are connected as a whole, which rotates under the drive of the motor to open or close the door, and at this time, the elastic member is compressed. When the electromagnet is powered off, under the action of the restoring force of the elastic member, the connecting rod moves away from the shaft hole, and the connecting rod is disengaged from the shaft hole.

It needs to be noted that, with respect to the sequence of energization of the electromagnet and the motor, they can be powered on at the same time. At this time, under the action of the electromagnet, the connecting rod moves close to the shaft hole. Meanwhile, under the drive of the motor, the connecting rod rotates, that is, the connecting rod rotates while moving close to the shaft hole and is inserted into the shaft hole. Alternatively, the electromagnet and the motor can also be powered on at different times, for example, the electromagnet is powered on firstly. In this way, under the action of the electromagnet, the connecting rod moves close to the shaft hole and is inserted into the shaft hole, so that the output shaft of the reduction box, the rotating shaft and the connecting rod are connected as a whole. Then the motor is powered on to drive the reduction box to rotate to drive the connecting rod to rotate by means of the output shaft of the reduction box, and in turn, drive the rotating shaft to rotate.

The embodiment of another aspect of the present disclosure provides a refrigerator, including: a refrigerator body; a door rotatably connected to the refrigerator body by means of a rotating shaft, wherein the rotating shaft is fixedly connected to the door, and a shaft hole is formed in the rotating shaft; and the door opening and closing device according to any one of the above embodiments, wherein the connecting rod of the door opening and closing device is arranged on the door.

According to the refrigerator provided by the above embodiment of the present disclosure, the door opening and closing device is arranged on the door, the second end of the connecting rod is inserted into the shaft hole under the drive of the second drive means, the first drive means drives the connecting rod to rotate, thereby realizing the rotation of the rotating shaft and realizing the automatic opening and closing of the door. When the first drive means and the second drive means are not operating, the elastic member drives the connecting rod to move away from the shaft hole, and the connecting rod is separated from the shaft hole.

In the above technical solution, preferably, a first rotating shaft is fixedly connected to the upper end of the door, a first shaft hole is formed in the first rotating shaft, the door opening and closing device includes a first door opening and closing device, and the second end of the connecting rod of the first door opening and closing device matches the first shaft hole; and/or, a second rotating shaft is fixedly connected to the lower end of the door, a second shaft hole is formed in the second rotating shaft, the door opening and closing device includes a second door opening and closing device, and the second end of the connecting rod of the second door opening and closing device matches the second shaft hole.

In the above embodiment, one door opening and closing device can be arranged on the refrigerator. For example, the connecting rod of the first door opening and closing device can be connected to or separated from the first rotating shaft, so that the first door opening and closing device drives the first rotating shaft to rotate, or the connecting rod of the second door opening and closing device can be connected to or separated from the second rotating shaft, so that the second door opening and closing device drives the second rotating shaft to rotate. Of course, the first door opening and closing device and the second door opening and closing device can also be arranged at the same time, so that the first door opening and closing device drives the first rotating shaft to rotate while the second door opening and closing device drives the second rotating shaft to rotate.

Additional aspects and advantages of the present disclosure will become apparent in the following descriptions or understood through the practice of the present disclosure.

BRIEF DESCRIPTION OF THE DRAWINGS

The above and/or additional aspects and advantages of the present disclosure will become apparent and readily understood from the following descriptions of the embodiments in connection with the accompanying figures, wherein.

Figure 1:
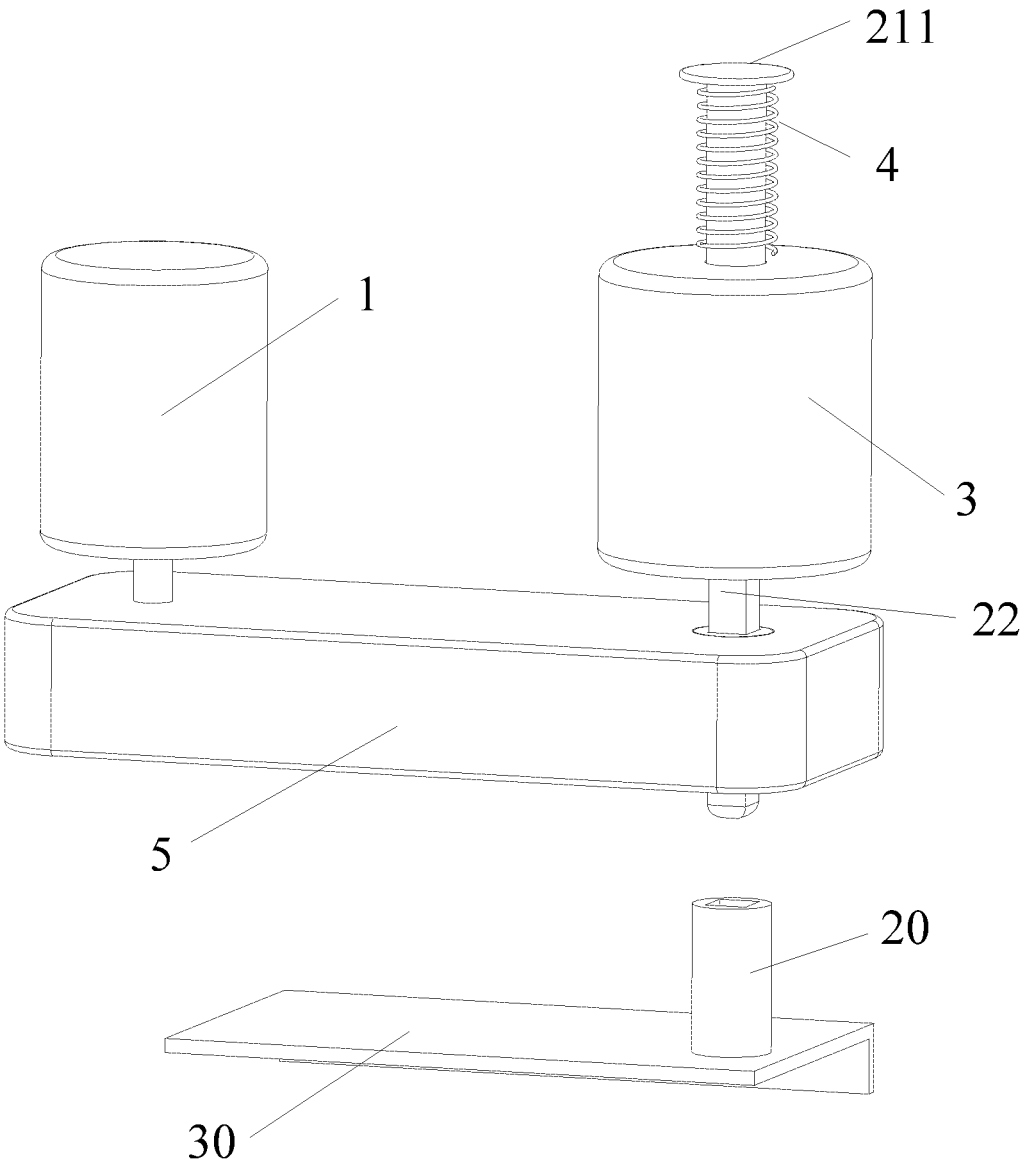
FIG. 1 is a schematic diagram of a three-dimensional structure of cooperation of a door opening and closing device and a rotating shaft in an embodiment of the present disclosure, wherein a second end of a connecting rod is not inserted into a shaft hole.

The corresponding relationship between reference signs and component names in FIGS. 1 to 12 is as follows: 1 motor, 2 connecting rod, 21 first end, 211 extension portion, 22 second end, 3 electromagnet, 31 first through hole, 4 elastic member, 5 reduction box, 51 second through hole, 20 rotating shaft, 201 shaft hole, 30 hinge bracket.

DETAILED DESCRIPTION OF THE EMBODIMENTS

The present disclosure will be further described in detail below in combination with the drawings and specific embodiments to understand the above objects, features and advantages of the present disclosure more clearly. It needs to be noted that the embodiments in the present application and the features in the embodiments may be combined with each other without conflict.

In the following description, numerous specific details are set forth in order to provide a thorough understanding of the present disclosure, but the present disclosure may be implemented otherwise than as described herein. Therefore, the protection scope of the present disclosure is not limited to the specific embodiments described below.

A door opening and closing device and a refrigerator according to some embodiments of the present disclosure are described below with reference to the drawings.

As shown in FIGS. 1 to 4, FIG. 6, FIG. 7, FIG. 10 and FIG. 11, a door opening and closing device provided according to some embodiments of the present disclosure is applied to a refrigerator, a door of the refrigerator is rotatably connected to a refrigerator body by means of a rotating shaft 20. The rotating shaft 20 is fixedly connected to the door, a shaft hole 201 is formed in the rotating shaft 20, and the door opening and closing device includes a connecting rod 2, a first drive means, a second drive means and an elastic member 4. The connecting rod 2 is arranged on the door, and the connecting rod 2 includes a first end 21 and a second end 22 that matches the shaft hole 201. The first drive means is connected to the connecting rod 2 and is configured to drive the connecting rod 2 to rotate, the second drive means is configured to drive the connecting rod 2 to move towards the shaft hole 201, and cause the second end 22 of the connecting rod 2 to be inserted into the shaft hole 201. After the second end 22 of the connecting rod 2 is inserted into the shaft hole 201, the elastic member 4 is compressed, so that the elastic member 4 drives the connecting rod 2 to move away from the shaft hole 201. After the second drive means drives the second end 22 of the connecting rod 2 to be inserted into the shaft hole 201, the first drive means drives, by means of the connecting rod 2, the rotating shaft 20 to rotate, so as to make the door rotate relative to the refrigerator body.

In the door opening and closing device according to the above-mentioned embodiment of the present disclosure, the rotating shaft 20 is fixedly connected to the door, and the door is rotatably connected to the refrigerator body by means of the rotating shaft 20. When the second drive means is operating, the second drive means drives the connecting rod 2 to move towards the shaft hole 201 and causes the second end 22 of the connecting rod 2 to insert into the shaft hole 201, thereby achieving the connection between the connecting rod 2 and the rotating shaft 20. At this time, the first drive means operates, the first drive means drives the connecting rod 2 to rotate so as to drive, by means of the connecting rod 2, the rotating shaft 20 to rotate and open and close the door, thereby achieving automatic door opening and closing of the refrigerator, and improving the convenience for users, especially the elderly and the children, to use the refrigerator. At this time, the elastic member 4 is compressed, and after the second drive means stops operating, under the action of the restoring force of the elastic member 4, the connecting rod 2 moves away from the shaft hole 201 and is disengaged from the shaft hole 201. In this way, the rotating shaft 20 is no longer connected to the first drive means, and the opening and closing of the door of the refrigerator can be realized manually. Therefore, when the refrigerator is powered off or the door opening and closing device is abnormal, the door can still be manually opened and closed.

It needs to be noted that, with respect to the sequence of energization (operating) of the second drive means and the first drive means, they can be powered on at the same time. At this time, under the action of the second drive means, the connecting rod 2 moves close to the shaft hole 201. In the meantime, under the drive of the first drive means, the connecting rod 2 rotates, that is, the connecting rod 2 rotates while moving close to the shaft hole 201 and is inserted into the shaft hole 201. Alternatively, the second drive means and the first drive means can also be powered on at different times. For example, the second drive means is powered on at first. In this way, under the action of the second drive means, the connecting rod 2 moves close to the shaft hole 201 and is inserted into the shaft hole 201, so that the rotating shaft 20 and the connecting rod 2 are connected as a whole. Then the first drive means is powered on to drive the connecting rod 2 to rotate and drive the rotating shaft 20 to rotate.

Figure 2:
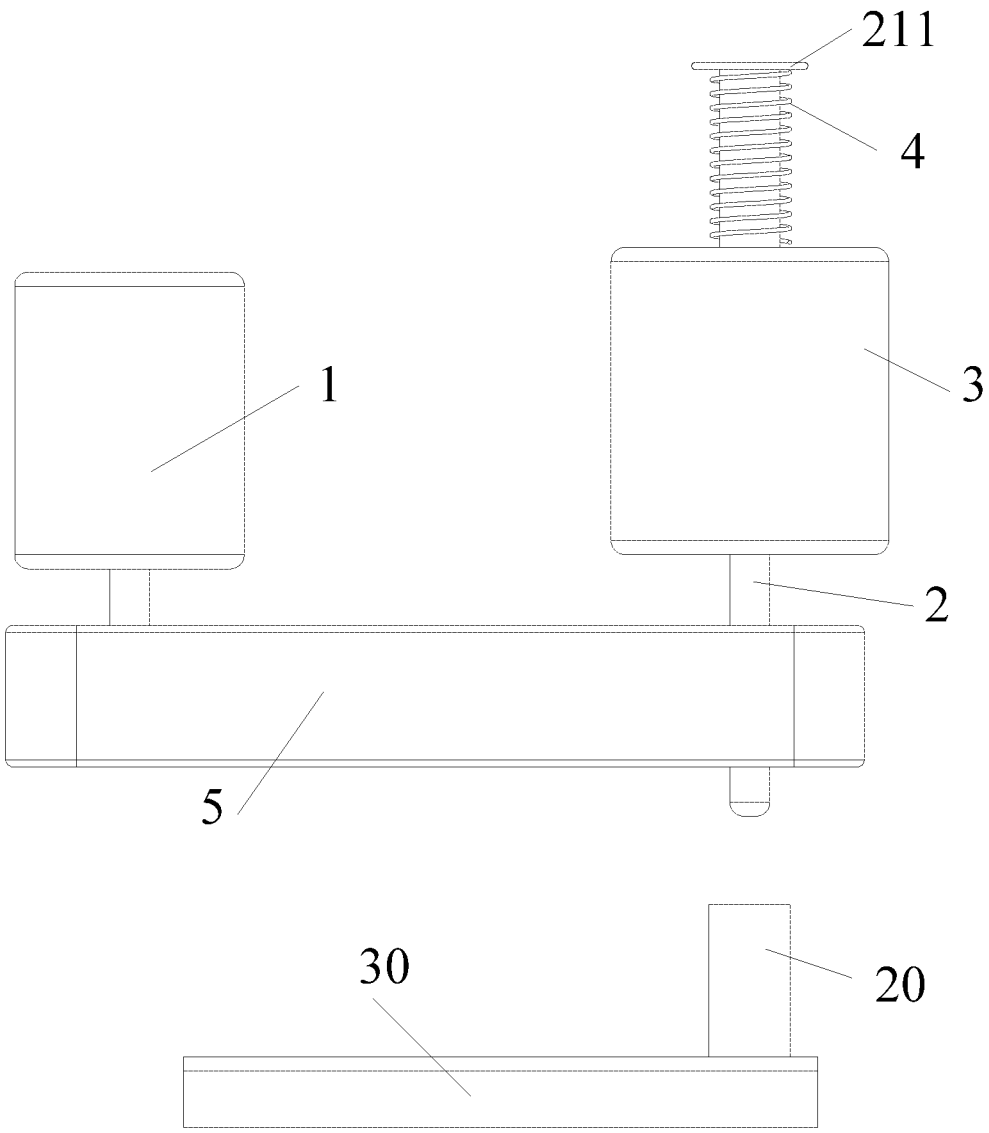
FIG. 2 is a structural schematic diagram of one view angle of the cooperation of the door opening and closing device and the rotating shaft as shown in FIG. 1.
Figure 3:
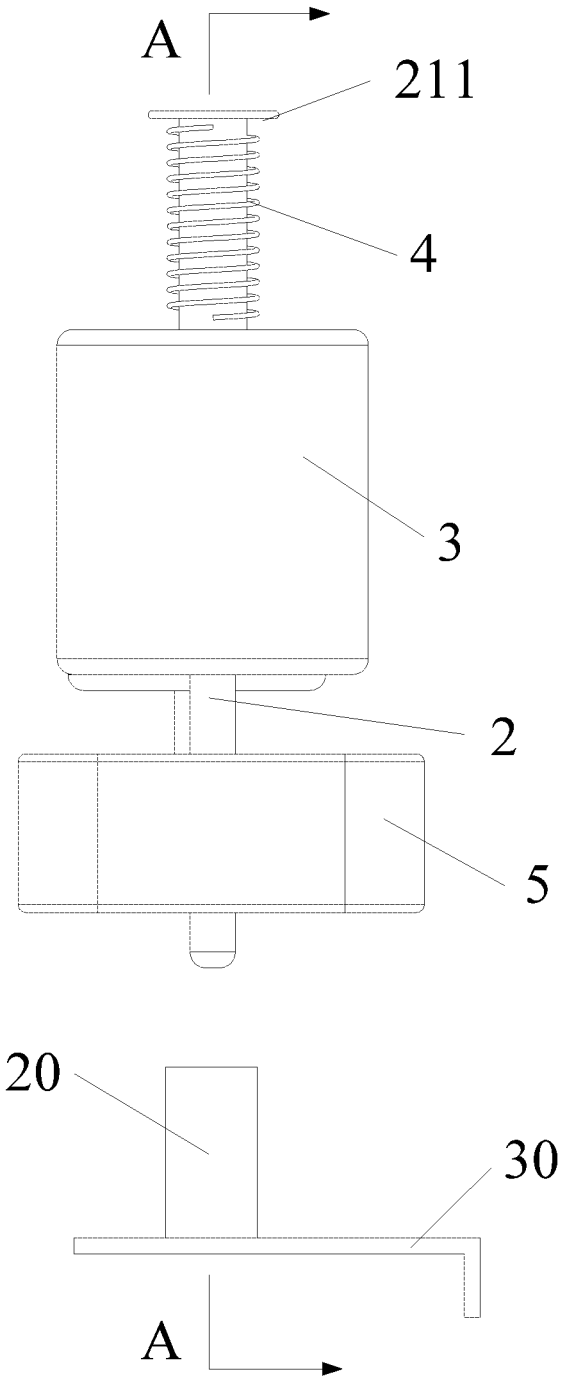
FIG. 3 is a structural schematic diagram of another view angle of the cooperation of the door opening and closing device and the rotating shaft as shown in FIG. 1.
Figure 4:
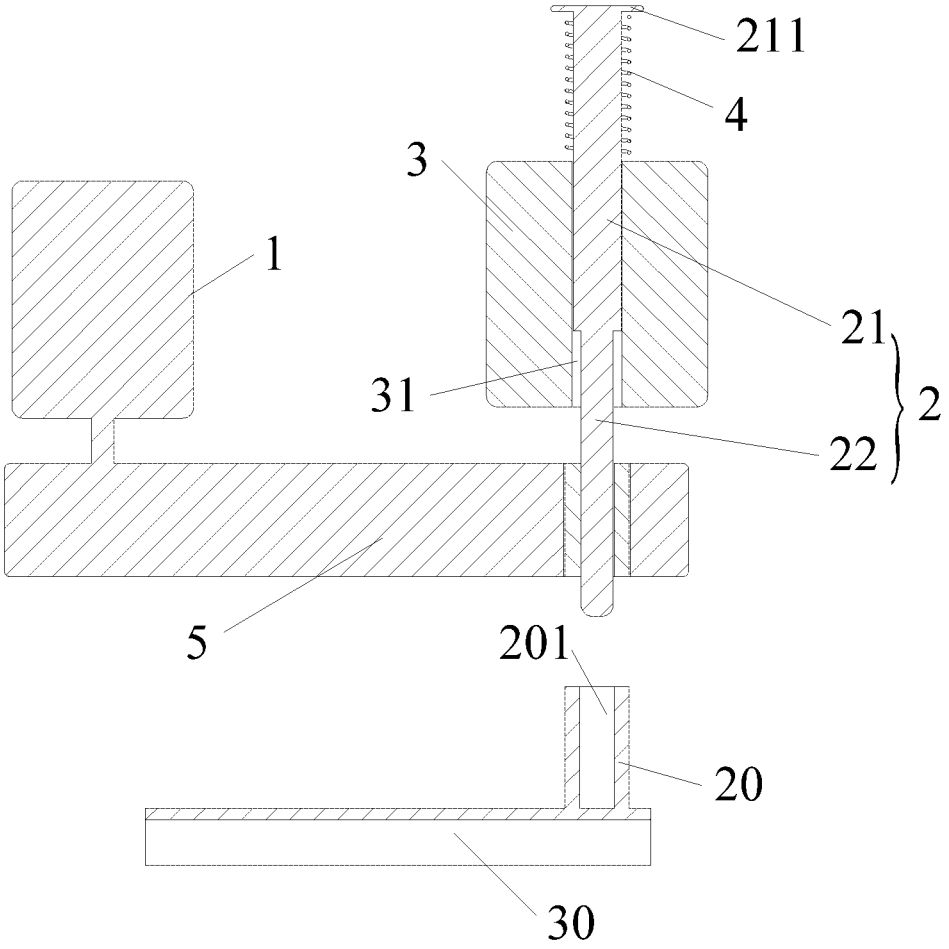
FIG. 4 is a schematic diagram of a sectional structure of an A-A direction in FIG. 3.
Figure 5:
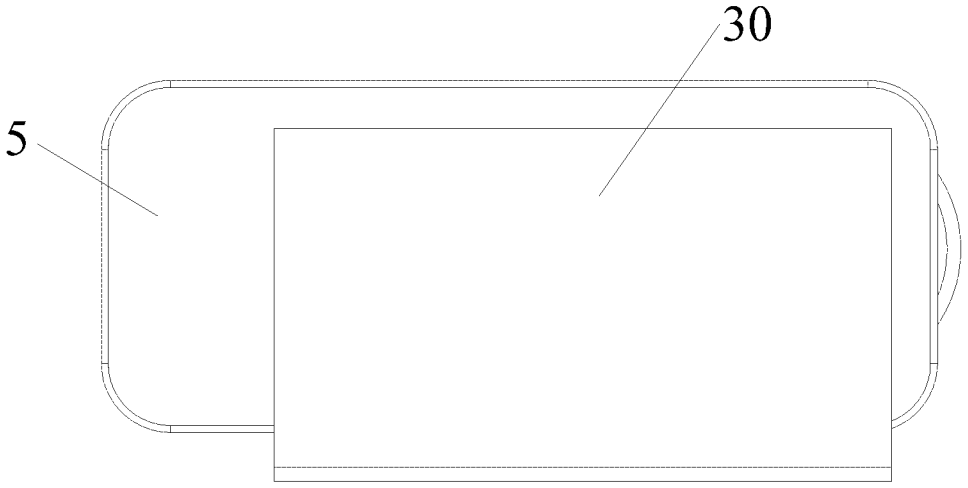
FIG. 5 is a structural schematic diagram of yet another view angle of the cooperation of the door opening and closing device and the rotating shaft as shown in FIG. 1.
Figure 6:
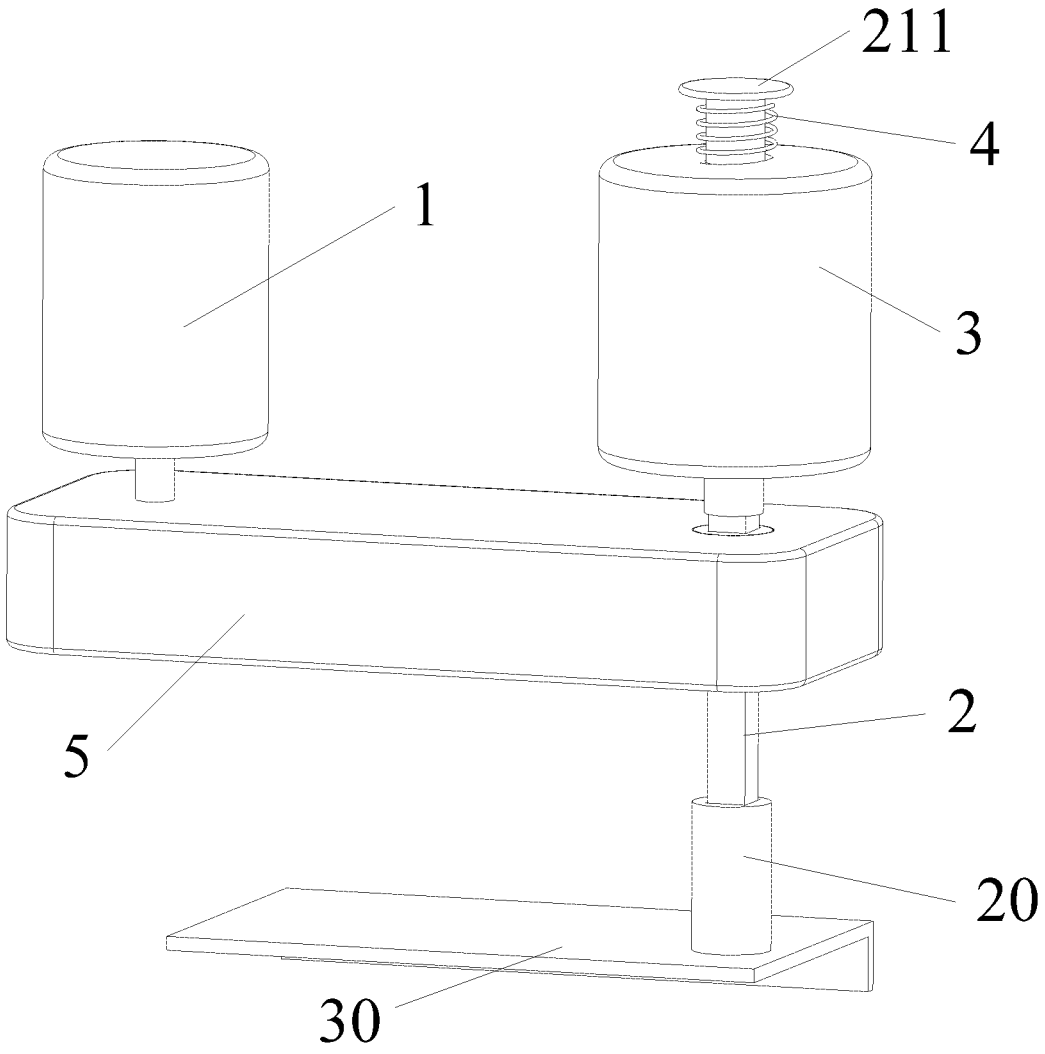
FIG. 6 is a schematic diagram of a three-dimensional structure of cooperation of a door opening and closing device and a rotating shaft in an embodiment of the present disclosure, wherein a second end of a connecting rod is inserted into a shaft hole.
Figure 7:
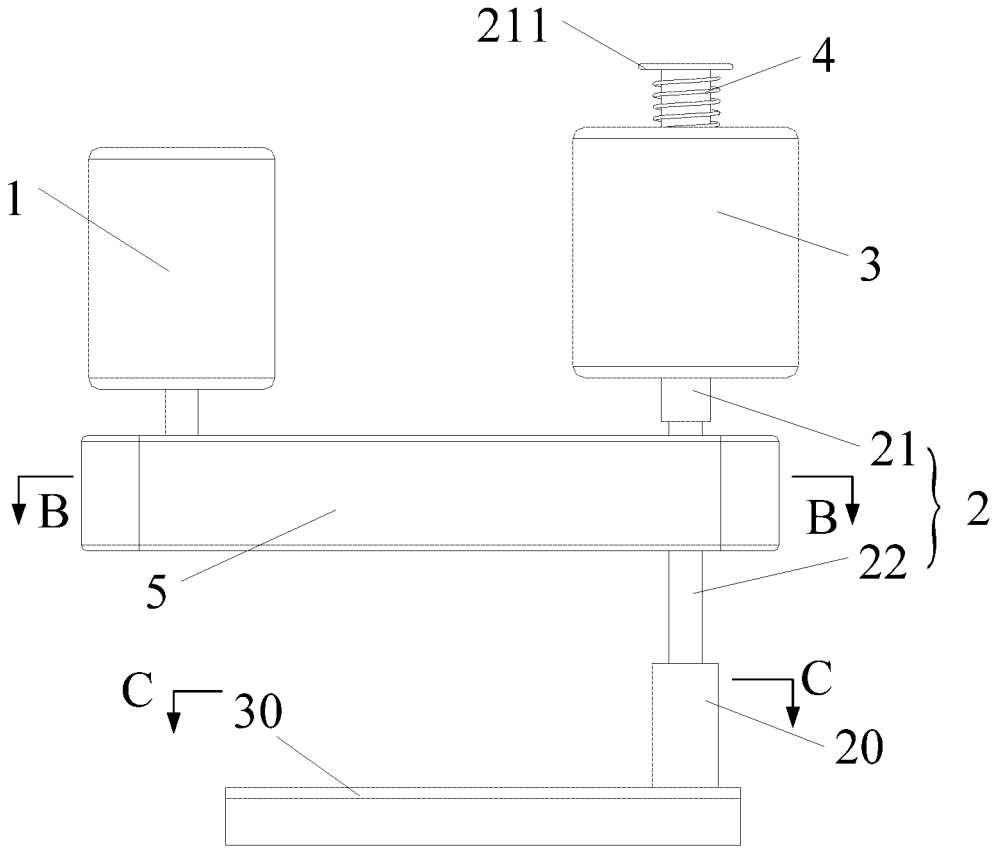
FIG. 7 is a structural schematic diagram of one view angle of the cooperation of the door opening and closing device and the rotating shaft as shown in FIG. 6.

Preferably, as shown in FIGS. 1 and 2, a hinge bracket 30 is fixedly connected to the door, a rotating shaft 20 facing to the door is fixedly connected to the hinge bracket 30, and a part of or all of the rotating shaft 20 is located in the door. Further, an upper hinge bracket is fixedly connected to the upper end of the door, a first rotating shaft is arranged on the upper hinge bracket, a lower hinge bracket is fixedly connected to the lower end of the door, a second rotating shaft is arranged on the lower hinge bracket, the first rotating shaft can be connected to or separated from the connecting rod 2 of a first door opening and closing device, and/or the second rotating shaft can be connected to or separated from the connecting rod 2 of a second door opening and closing device. In the present patent, the operating principle of the door opening and closing device is illustrated by using the following hinge bracket and the second rotating shaft as an example.

Preferably, as shown in FIGS. 1 to 4, FIG. 6, FIG. 7, FIG. 10 and FIG. 11, the second drive means is an electromagnet 3, a first through hole 31 matching the first end 21 of the connecting rod 2 is formed in the electromagnet 3, and the first end 21 of the connecting rod 2 penetrates the first through hole 31. When the electromagnet 3 is powered on, the electromagnet 3 attracts the connecting rod 2 to cause the connecting rod 2 to move towards the shaft hole 201.

In the above embodiment, when the electromagnet 3 is powered on, the electromagnet 3 attracts the connecting rod 2 to cause the connecting rod 2 to move towards the shaft hole 201 (the downward direction in FIG. 10), and the second end 22 of the connecting rod 2 is inserted into the shaft hole 201, realizing the connection between the connecting rod 2 and the rotating shaft 20. Therefore, the motor 1 drives the rotating shaft 20 to rotate through the connecting rod 2 so as to open the door. Additionally, the second drive means can also be a pinion and rack structure, and the movement of the connecting rod 2 close to the shaft hole 201 is realized by the transmission of the pinion and rack.

Preferably, as shown in FIGS. 1 to 4, FIG. 6, FIG. 7, FIG. 10 and FIG. 11, the elastic member 4 is supported between the first end 21 of the connecting rod 2 and an end face of the electromagnet 3 away from the shaft hole 201.

In the above embodiment, after the second end 22 of the connecting rod 2 is inserted into the shaft hole 201, the elastic member 4 is compressed, and after the electromagnet 3 is powered off, under the action of the restoring force of the elastic member 4, the connecting rod 2 moves away from the shaft hole 201 (the upward direction in FIG. 1) and is disengaged from the shaft hole 201. In this way, the rotating shaft 20 is no longer connected to the first drive means, and the opening and closing of the door of the refrigerator can be realized manually. Therefore, when the refrigerator is powered off or the door opening and closing device is abnormal, the door can still be manually opened and closed.

The first drive means is a motor 1, and preferably a stepping motor 1.

The stepping motor 1 can accurately control the rotation angle of the door, thereby improving the operating accuracy of the door opening and closing device. Preferably, the motor 1 is a DC stepping motor 1.

Preferably, as shown in FIGS. 1 to 7, and FIGS. 10 to 12, the door opening and closing device further includes a reduction box 5 connected between the motor 1 and the connecting rod 2, a second through hole 51 matching the second end 22 of the connecting rod 2 is formed in an output shaft of the reduction box 5, and the second end 22 of the connecting rod 2 penetrates the second through hole 51.

In the above embodiment, the reduction box 5 is connected between the motor 1 and the second end 22 of the connecting rod 2, the motor 1 drives the connecting rod 2 to rotate through the reduction box 5 so as to drive the rotating shaft 20 to rotate. The reduction box 5 can convert the high rotating speed and the low torque of the motor 1 into the low rotating speed and the high torque, thus better driving the rotating shaft 20 to rotate.

Figure 8:
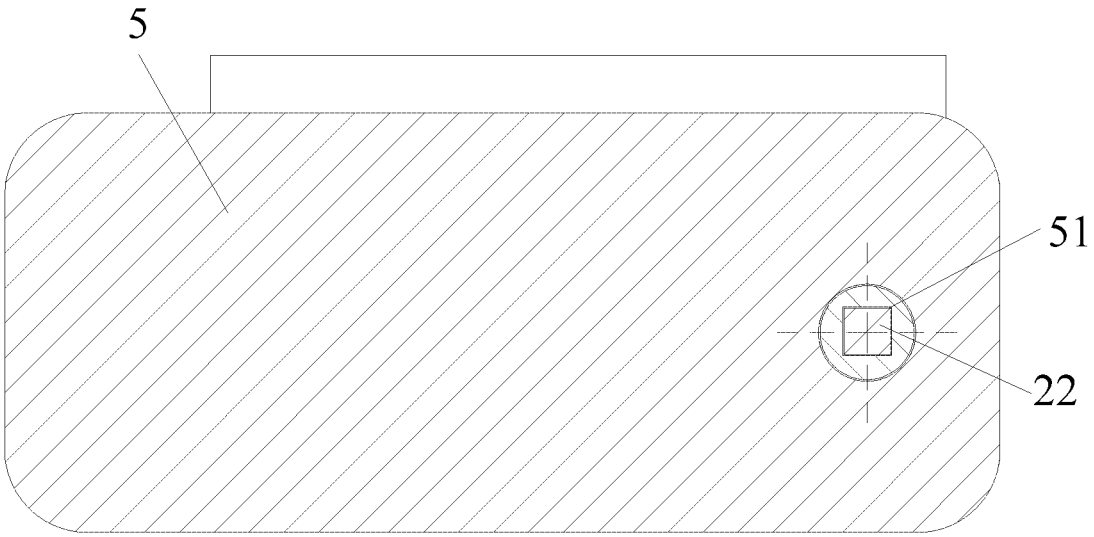
FIG. 8 is a schematic diagram of a sectional structure of a B-B direction in FIG. 7.
Figure 9:
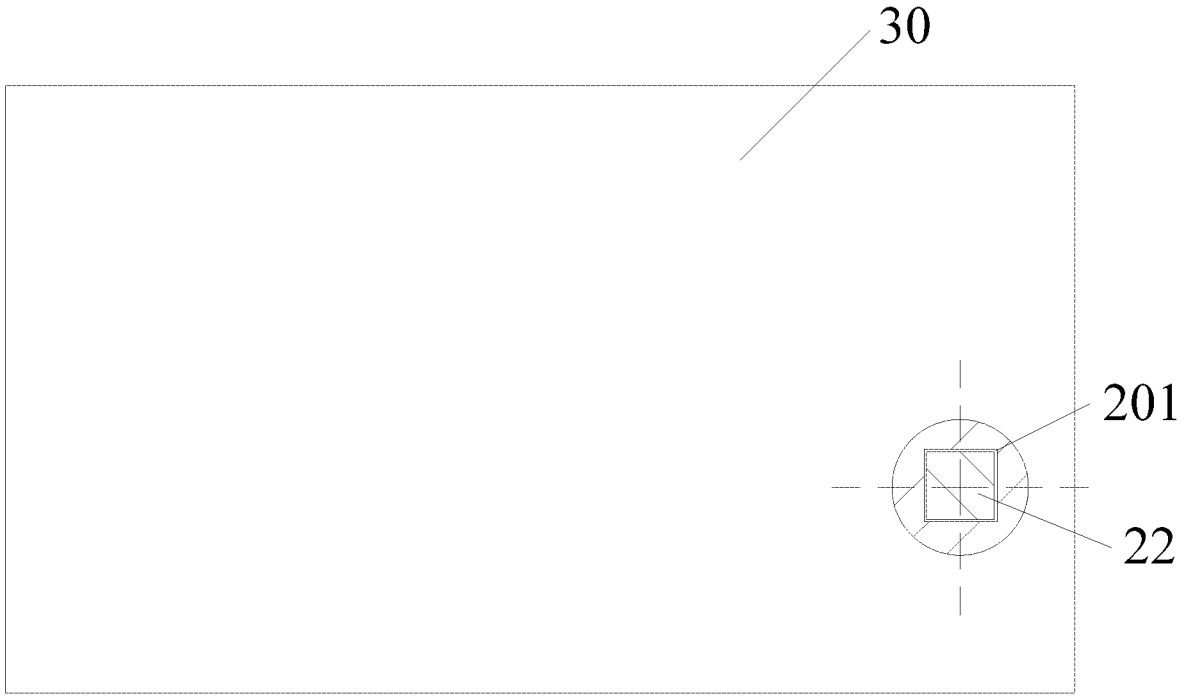
FIG. 9 is a schematic diagram of a sectional structure of a C-C direction in FIG. 7.
Figure 10:
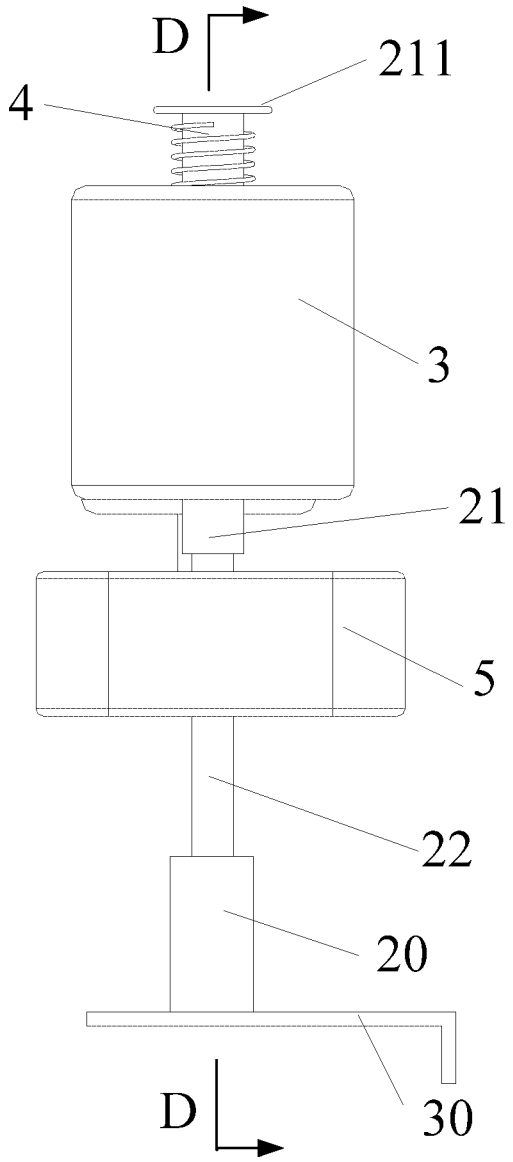
FIG. 10 is a structural schematic diagram of another view angle of the cooperation of the door opening and closing device and the rotating shaft as shown in FIG. 6.
Figure 11:
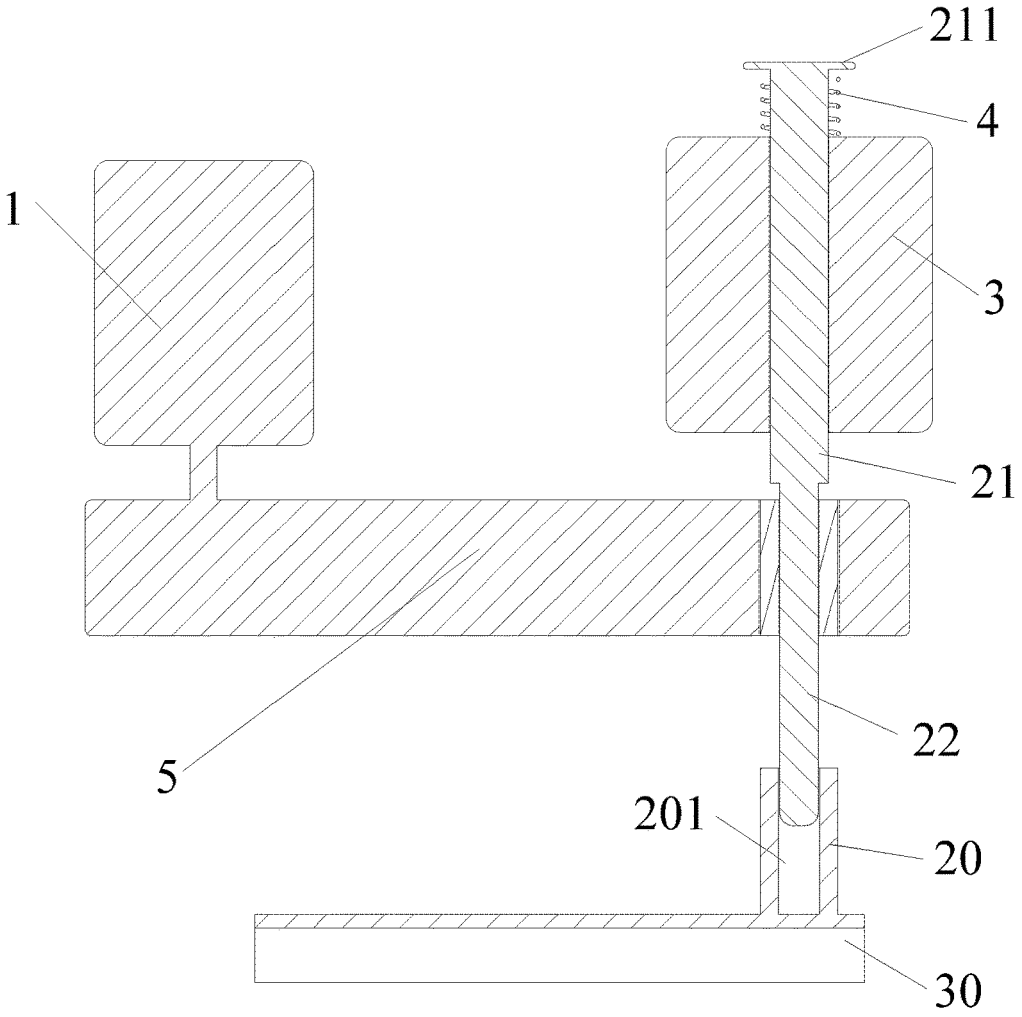
FIG. 11 is a schematic diagram of a sectional structure of a D-D direction in FIG. 10.
Figure 12:
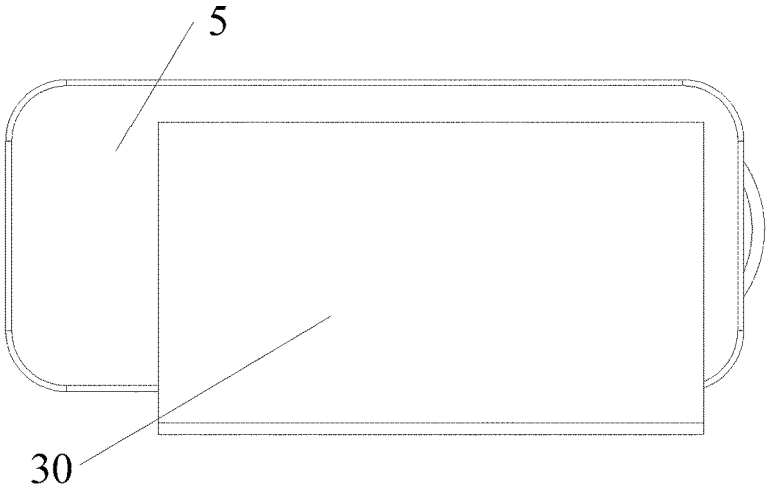
FIG. 12 is a structural schematic diagram of yet another view angle of the cooperation of the door opening and closing device and the rotating shaft as shown in FIG. 6.

Preferably, as shown in FIGS. 8 and 9, the second end 22 of the connecting rod 2 has a polygonal cross section, and the shaft hole 201 and the second through hole 51 are both polygonal holes matching the second end 22 of the connecting rod 2.

The setting of the polygonal cross section can better realize the transmission of torque between the reduction box 5 and the rotating shaft 20. The polygon can be a triangle, a quadrangle, or the like.

Preferably, the first end 21 of the connecting rod 2 has a circular cross section, and correspondingly, the first through hole 31 is a circular hole.

Preferably, the axis of the shaft hole 201, the axis of the first through hole 31 and the axis of the second through hole 51 coincide with the axis of the connecting rod 2.

In the above embodiment, when the electromagnet 3 is powered on, the connecting rod 2 moves close to the shaft hole 201 along the first through hole 31 and penetrates the second through hole 51 to be inserted into the shaft hole 201. Therefore, the axis of the shaft hole 201, the axis of the first through hole 31 and the axis of the second through hole 51 coincide with each other. Thus, the smoothness of inserting the connecting rod 2 into the shaft hole 201 and the operating reliability of the door opening and closing device can be improved.

Preferably, as shown in FIGS. 1 to 7, FIG. 10 and FIG. 11, the elastic member 4 is a spiral spring or a spring piece.

Preferably, an end face of the first end 21 of the connecting rod 2 away from the shaft hole 201 extends outward to form an extension portion 211, and the elastic member 4 is supported between the extension portion 211 and an end face of one end of the electromagnet 3 away from the shaft hole 201.

As shown in FIGS. 1 to 4, when the door opening and closing device is not powered on, under the action of the elastic force of the elastic member 4, the second end 22 of the connecting rod 2 is disengaged from the shaft hole 201. Preferably, the second end 22 of the connecting rod 2 still penetrates the second through hole 51. At this time, the rotating shaft 20 is not controlled by the door opening and closing device, and the door can be manually opened and closed. As shown in FIGS. 6, 7, 10 and 11, after the electromagnet 3 is powered on, the electromagnet 3 attracts the connecting rod 2, the connecting rod 2 moves close to the shaft hole 201 (downward), and the second end 22 of the connecting rod 2 is inserted into the shaft hole 201. Thus, the connecting rod 2, the output shaft of the reduction box 5 and the rotating shaft 20 are connected as a whole, which rotates under the drive of the motor 1 to open or close the door, while the elastic member 4 is compressed. When the electromagnet 3 is powered off, under the action of the restoring force of the elastic member 4, the connecting rod 2 moves away from the shaft hole 201 (upward), and the connecting rod 201 is disengaged from the shaft hole 201.

It needs to be noted that, with respect to the sequence of energization (operating) of the electromagnet 3 and the motor 1, they can be powered on at the same time. At this time, under the action of the electromagnet 3, the connecting rod 2 moves close to the shaft hole 201, while the connecting rod 2 rotates under the drive of the motor 1, that is, the connecting rod 2 rotates while moving close to the shaft hole 201 and is inserted into the shaft hole 201. Alternatively, the electromagnet 3 and the motor 1 can also be powered on at different times. For example, the electromagnet 3 is powered on firstly. In this way, under the action of the electromagnet 3, the connecting rod 2 moves close to the shaft hole 201 and is inserted into the shaft hole 201, so that the output shaft of the reduction box 5, the rotating shaft 20 and the connecting rod 2 are connected as a whole. Then the motor 1 is powered on to drive the reduction box 5 to rotate and drive the connecting rod 2 to rotate by means of the output shaft of the reduction box 5 so as to drive the rotating shaft 20 to rotate.

The embodiment of another aspect of the present disclosure provides a refrigerator, including: a refrigerator body, a door and the door opening and closing device according to any one of the above embodiments; the door is rotatably connected to the refrigerator body by means of a rotating shaft 20, wherein the rotating shaft 20 is fixedly connected to the door, and a shaft hole 201 is formed in the rotating shaft 20; and the connecting rod 2 of the door opening and closing device is arranged on the door.

In the refrigerator according to the above embodiment of the present disclosure, the door opening and closing device is arranged on the door, the second end 22 of the connecting rod 2 is inserted into the shaft hole 201 under the drive of the second drive means, the first drive means drives the connecting rod 2 to rotate, realizing the rotation of the rotating shaft 20, and thus, realizing the automatic opening and closing of the door. When the first drive means and the second drive means are not operating, the elastic member 4 drives the connecting rod 2 to move away from the shaft hole 201, and the connecting rod 2 is separated from the shaft hole 201.

Preferably, a first rotating shaft is fixedly connected to the upper end of the door, a first shaft hole is formed in the first rotating shaft, the door opening and closing device includes a first door opening and closing device, and the second end of the connecting rod of the first door opening and closing device matches the first shaft hole; and/or, a second rotating shaft is fixedly connected to the lower end of the door, a second shaft hole is formed in the second rotating shaft, the door opening and closing device includes a second door opening and closing device, and the second end of the connecting rod of the second door opening and closing device matches the second shaft hole.

In the above embodiment, one door opening and closing device can be arranged on the refrigerator. For example, the first door opening and closing device drives the first rotating shaft to rotate, or the second door opening and closing device drives the second rotating shaft to rotate. Alternatively, the first door opening and closing device and the second door opening and closing device can also be arranged at the same time, and the first door opening and closing device drives the first rotating shaft to rotate while the second door opening and closing device drives the second rotating shaft to rotate.

In summary, in the door opening and closing device according to the embodiment of the present disclosure, when the second drive means is operating, the second drive means drives the connecting rod 2 to move towards the shaft hole 201, achieving the connection between the connecting rod 2 and the rotating shaft 20. In the meantime, the first drive means operates, the first drive means drives the connecting rod 2 to rotate so as to drive, by means of the connecting rod 2, the rotating shaft 20 to rotate and open and close the door. After the second drive means stops operating, under the action of the restoring force of the elastic member 4, the connecting rod 2 moves away from the shaft hole 201. In this way, the rotating shaft 20 is no longer connected to the first drive means, and the opening and closing of the door of the refrigerator can be realized manually. Therefore, when the refrigerator is powered off or the door opening and closing device is abnormal, the door can still be manually opened and closed.

In the description of the present disclosure, the term "plurality" means two or more unless specifically stated or defined otherwise. Unless otherwise specified or stated, the terms "connected", "fixed" and the like should be understood in a broad sense, for example, the "connection" may be a fixed connection, a detachable connection, or an integral connection, or an electrical connection. It may be direct connection or indirect connection through an intermediate medium. The specific meanings of the above terms in the present disclosure can be understood by those of ordinary skilled in the art in accordance with specific conditions.

In the description of the specification, it should be understood that the orientations or positional relationships indicated by the terms "upper", "lower", "front", "rear", "left", "right" and the like are orientations or positional relationships shown in the drawings, merely for facilitating to the description of the present disclosure and the simplification of the description. It is not intended to indicate or imply that the referred devices or units must have specific orientations, are constructed and operated in specific orientations, and therefore cannot be construed as limitation to the present disclosure.

In the description of the present specification, the description of the terms "one embodiment", "some embodiments", "specific embodiments" and the like means that the specific features, structures, materials or characteristics described in combination with the embodiments or examples are included in at least one embodiment or example of the present disclosure. In the present specification, the schematic expression of the above terms does not necessarily refer to the same embodiment or example. Furthermore, the particular features, structures, materials, or characteristics described may be combined in a suitable manner in any one or more embodiments or examples.

The above descriptions are only preferred embodiments of the present disclosure, and are not intended to limit the present disclosure. Various modifications and changes can be made to the present disclosure for those skilled in the art. Any modifications, equivalent substitutions, improvements and the like made within the spirit and scope of the present disclosure should be included within the protection scope of the present disclosure.

What is claimed is:

1. A door opening and closing device for a refrigerator, a door of the refrigerator being rotatably connected to a refrigerator body by means of a rotating shaft, wherein the rotating shaft is fixedly connected to the door, a shaft hole is formed in the rotating shaft, the door opening and closing device comprising:

a connecting rod arranged on the door, the connecting rod including a first end and a second end that matches the shaft hole;

a first drive means connected to the connecting rod and configured to drive the connecting rod to rotate;

a second drive means configured to drive the connecting rod to move towards the shaft hole, and cause the second end of the connecting rod to be inserted into the shaft hole; and an elastic member, wherein the elastic member is compressed after the second end of the connecting rod is inserted into the shaft hole so that the elastic member can drive the connecting rod to move away from the shaft hole; and wherein after the second drive means drives the second end of the connecting rod to be inserted into the shaft hole, the first drive means drives, by means of the connecting rod, the rotating shaft to rotate, so as to make the door rotate relative to the refrigerator body.

2. The door opening and closing device according to claim 1, wherein the second drive means is an electromagnet, a first through hole matching the first end of the connecting rod is formed in the electromagnet, the first end of the connecting rod penetrates the first through hole, and when the electromagnet is powered on, the electromagnet attracts the connecting rod to cause the connecting rod to move towards the shaft hole.

3. The door opening and closing device according to claim 2, wherein the elastic member is supported between the first end of the connecting rod and an end face of the electromagnet away from the shaft hole.

4. The door opening and closing device according to claim 1, wherein the first drive means is a motor.

5. The door opening and closing device according to claim 4, further comprising:

a reduction box connected between the motor and the connecting rod, wherein a second through hole matching the second end of the connecting rod is formed in an output shaft of the reduction box, and the second end of the connecting rod penetrates the second through hole.

6. The door opening and closing device according to claim 5, wherein the second end of the connecting rod has a polygonal cross section, and the shaft hole and the second through hole are both polygonal holes matching the second end of the connecting rod.

7. The door opening and closing device according to claim 5, wherein the axis of the shaft hole and the axis of the second through hole coincide with the axis of the connecting rod.

8. The door opening and closing device according to claim 1, wherein the elastic member is a spiral spring or a spring piece.

9. A refrigerator, comprising:

a refrigerator body;

a door rotatably connected to the refrigerator body by means of a rotating shaft, wherein the rotating shaft is fixedly connected to the door, and a shaft hole is formed in the rotating shaft;

a connecting rod arranged on the door, the connecting rod including a first end and a second end that matches the shaft hole;

a first drive means connected to the connecting rod and configured to drive the connecting rod to rotate;

a second drive means configured to drive the connecting rod to move towards the shaft hole, and cause the second end of the connecting rod to be inserted into the shaft hole; and an elastic member, wherein the elastic member is compressed after the second end of the connecting rod is inserted into the shaft hole so that the elastic member can drive the connecting rod to move away from the shaft hole; and wherein after the second drive means drives the second end of the connecting rod to be inserted into the shaft hole, the first drive means drives, by means of the connecting rod, the rotating shaft to rotate, so as to make the door rotate relative to the refrigerator body.

10. The refrigerator according to claim 9, wherein the second drive means is an electromagnet, a first through hole matching the first end of the connecting rod is formed in the electromagnet, the first end of the connecting rod penetrates the first through hole, and when the electromagnet is powered on, the electromagnet attracts the connecting rod to cause the connecting rod to move towards the shaft hole.

11. The refrigerator according to claim 10, wherein the elastic member is supported between the first end of the connecting rod and an end face of the electromagnet away from the shaft hole.

12. The refrigerator according to claim 11, wherein the first drive means is a motor.

13. The refrigerator according to claim 12, further comprising:

a reduction box connected between the motor and the connecting rod, wherein a second through hole matching the second end of the connecting rod is formed in an output shaft of the reduction box, and the second end of the connecting rod penetrates the second through hole.

14. The refrigerator according to claim 13, wherein the second end of the connecting rod has a polygonal cross section, and the shaft hole and the second through hole are both polygonal holes matching the second end of the connecting rod.

15. The refrigerator according to claim 13, wherein the axis of the shaft hole and the axis of the second through hole coincide with the axis of the connecting rod.

16. The refrigerator according to claim 11, wherein a first rotating shaft is fixedly connected to the upper end of the door, a first shaft hole is formed in the first rotating shaft, the door opening and closing device comprises a first door opening and closing device, and the second end of the connecting rod of the first door opening and closing device matches the first shaft hole; or a second rotating shaft is fixedly connected to the lower end of the door, a second shaft hole is formed in the second rotating shaft, the door opening and closing device comprises a second door opening and closing device, and the second end of the connecting rod of the second door opening and closing device matches the second shaft hole.

17. The refrigerator according to claim 10, wherein a first rotating shaft is fixedly connected to the upper end of the door, a first shaft hole is formed in the first rotating shaft, the door opening and closing device comprises a first door opening and closing device, and the second end of the connecting rod of the first door opening and closing device matches the first shaft hole; or a second rotating shaft is fixedly connected to the lower end of the door, a second shaft hole is formed in the second rotating shaft, the door opening and closing device comprises a second door opening and closing device, and the second end of the connecting rod of the second door opening and closing device matches the second shaft hole.

18. The refrigerator according to claim 9, wherein the elastic member is a spiral spring or a spring piece.

19. The refrigerator according to claim 9, wherein:

a first rotating shaft is fixedly connected to the upper end of the door, a first shaft hole is formed in the first rotating shaft, the door opening and closing device comprises a first door opening and closing device, and the second end of the connecting rod of the first door opening and closing device matches the first shaft hole; or a second rotating shaft is fixedly connected to the lower end of the door, a second shaft hole is formed in the second rotating shaft, the door opening and closing device comprises a second door opening and closing device, and the second end of the connecting rod of the second door opening and closing device matches the second shaft hole.

* * * * *